United States Patent [19]

Ovadia

[11] 4,282,975

[45] Aug. 11, 1981

[54] JEWELRY DISPLAY TRAY

[76] Inventor: Joseph Ovadia, 343 Sackett St., Brooklyn, N.Y. 11231

[21] Appl. No.: 114,182

[22] Filed: Jan. 22, 1980

[51] Int. Cl.[3] ..... B65D 1/34; B65D 6/04

[52] U.S. Cl. ..... 206/566; 206/443; 206/818; 206/509

[58] Field of Search ..... 206/566, 503, 501, 443, 206/509, 512, 558, 563, 564, 818; 220/23.6; 229/2.5 R, 2.5 EC

[56] References Cited

U.S. PATENT DOCUMENTS

| | | | |
|---|---|---|---|
| 2,511,774 | 6/1950 | Goldsmith | 206/818 X |
| 2,684,820 | 7/1954 | Korn | 206/566 X |
| 3,196,229 | 7/1965 | Glass | 206/443 |
| 3,532,247 | 10/1970 | Bridges | 220/23.6 |

*Primary Examiner*—George T. Hall

*Attorney, Agent, or Firm*—Wolder, Gross & Yavner

[57] ABSTRACT

A jewelry display tray according to the present invention includes an upper structural member and a lower structural member. A plurality of recesses are formed in both the upper and lower members. The recesses in the upper member extend in a downward direction when the tray is in a substantially horizontal position, and are arranged in offsetting or staggered rows. The recesses in the lower member extend in an upward direction and are similarly arranged in offsetting or staggered rows. The upper and lower members are complimentarily assembled together so that the downwardly extending recesses of the upper member fit into spaces located between the upwardly extending recess of the lower member thus forming an interlocking structure. Similarly, the upwardly extending recesses of the lower member fit into spaces located between the downwardly extending recesses of the upper member. An upper surface element having access openings, overlies the recesses of the upper member. Items of jewelry can thus pass through the openings in the upper surface element so as to be accommodated in the downwardly extending recesses of the upper member. The upwardly extending recesses in the lower member permits receipt of exposed jewelry items accommodated in another tray thus permitting nesting of a plurality of jewelry display trays. This arrangement permits spaced apart positioning of the items of jewelry for highlighting the appearance of each individual item. The recess structure also provides means of protecting the jewelry items when stored.

15 Claims, 19 Drawing Figures

JEWELRY DISPLAY TRAY

BACKGROUND OF THE INVENTION

The present invention relates generally to devices for storing and displaying items of jewelry, and more particularly to such a storage and display device which can be used in the typical fashion for display purposes and can be compactly nested with similar devices for easy storage.

While jewelry items can be stored and displayed in a variety of trays, holders or racks, the most common type of jewelry display, particularly useful for rings, is a rectangularly shaped tray having an upper surface with a plurality of slits to accommodate the circular shank portion of the ring. Trays having other shapes are also found in the art. This known tray has a depth sufficient to accommodate at least half of the diameter of the ring, or its shank portion to provide stability to the ring when it is carried in the tray. The undersurface of this known tray is usually flat for placement on a surface for display purposes. Some prior art trays of this type are provided with a downwardly extending peripheral lip. This construction permits storage with other display trays of the identical size.

Placing the upper exposed surface of such a display tray beneath and within the peripheral lip of another display tray placed on top of it provides means for storing a number of identically shaped display trays one on top of the other in a manner which prevents the upper exposed portion of the jewelry items from being damaged. In order to keep the trays spaced apart, support elements are required to be provided on the underside of the tray. In some cases the peripheral lip provides this function.

Because it is necessary to provide spacer elements between the jewelry trays of the foregoing type, when in the storage condition, these trays tend to have an overall height of almost double the height of the jewelry item carried in the tray. Accordingly, storage of a number of these trays, one on top of the other, occupies a large amount of space and tends to make these types of trays heavy, bulky and difficult to place in a storage condition. It has therefore become common practice for jewelers to store jewelry items in separate storage cases remote from the display devices. This usually requires removal of the jewelry items from the display tray, which are carried in a display case or cabinet, and storing the jewelry items in separate storage containers during periods of non display, such as overnight or over weekend periods. In order to again place the jewelry items on display, they must be individually and separately removed from storage and placed within the display tray or on a separate holder. Sometimes, the entire display tray is removed for storage.

The prior art display trays have also been found difficult to use by traveling salespeople. For the reasons discussed above, most display trays cannot be stored in a compact and space saving condition. Accordingly, use of the typically known display trays in a traveling case is inconvenient and not practical.

It is accordingly a principal object of the present invention to provide a jewelry display device in the form of a tray which can be used both for display purposes and for compact storage with other similar display trays.

It is a more specific object of the present invention to provide a jewelry display tray which has a plurality of openings on its undersurface so that it can be easily nested with other display trays for compact storage.

Another object of the invention is to provide a jewelry display tray which facilitates presentation of the jewelry item in a pleasing arrangement, so as to allow each piece to be viewed and appreciated individually, while still allowing for compact storage.

Yet a further object of the present invention is to provide a jewelry display device which is made of materials light in weight so as to render the device usable for either display, storage or transit.

A further more specific object of the present invention is to create a jewelry storage tray which is capable of nesting with a plurality of identically constructed jewelry storage trays by taking advantage of a honeycomb cross-sectional construction between trays so that a plurality of trays can be stored in a compact fashion.

Still a further object of the invention is to provide a display tray which has great strength because of an interlocking structure between upper and lower members of the tray.

Other objects, features and advantages of the present invention will become apparent from the detailed description of the invention in connection with the appended drawings, to be described more fully hereinafter.

SUMMARY OF THE INVENTION

The foregoing features and advantages are generally accomplished by providing a jewelry display device in the form of a tray having an upper structural member and a lower structural member. A plurality of recesses are formed in the upper member and extend in a downward direction when a major plane of the tray is oriented in a substantially horizontal direction. These recesses are arranged in offsetting or staggered rows. A plurality of recesses extending in an upward direction are also arranged in the lower member. The upper and lower members are complimentarily fit together with the downwardly extending recesses of the upper member fitting in spaces located between the upwardly extending recesses of the lower member. The upwardly extending recesses of the lower member fit into spaces located between the downwardly extending recesses of the upper member. An interlocking structure is thus formed. Means having access openings overlay the upper member so that items of jewelry passing through the openings will be accommodated in the downwardly extending recesses of the upper member. This construction permits a plurality of trays to be nested together with the items of jewelry being stored in compartments formed between upwardly extending recesses of one tray and downwardly extending recesses of an adjacent tray. This arrangement also permits adequate spacing between items of jewelry so that each piece can be individually viewed and appreciated.

The foregoing and other features of the present invention are more fully described with reference to the following drawings.

DESCRIPTION OF THE INVENTION

Figure 1:
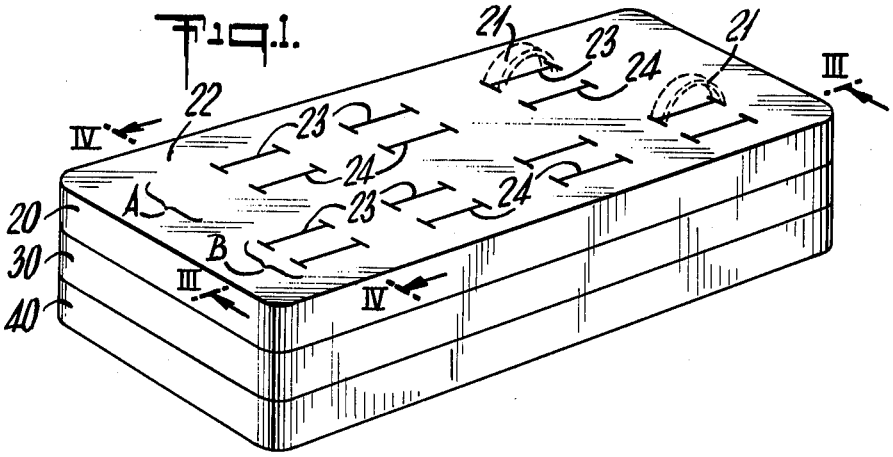
FIG. 1 is a perspective view illustrating three of the jewelry display tray devices of the present invention, each of which is designed for accommodating a plurality of wedding bandtype rings and all three shown in a nested condition for storage.

Referring now in more detail to the accompanying drawings, FIG. 1 illustrates in perspective view three separate jewelry display and storage trays 20, 30 and 40 of a first embodiment of the present invention. Each of the trays are of identical construction, to be described more fully hereinafter, and are arranged in a nested position suitable for storage. The embodiment of the present invention in FIG. 1 is particularly suited for carrying items of jewelry such as wedding bands 21, or other similar items of jewelry such as watches, bracelets, etc. For illustrative purposes, FIG. 1 shows the upper surface 22 of each of the trays 20, 30 and 40 having a plurality of slits arranged in pairs 23, 24. Each of the slits is dimensioned so as to receive one of the wedding bands 21. It should be understood that the arrangement of slits in pairs is not more preferable than singular slits, as will be understood from the further description hereinbelow, and is shown for example only.

The pairs of slits 23, 24 are arranged in rows. While any number of rows of slits can be provided, as will be described hereinafter in greater detail, the embodiment of FIG. 1 illustrates the use of only two rows A and B.

In FIG. 1 it will be noted that row A has three pairs of slits 23 and 24, while row B has four pairs of slits. The slits in row A are offset or staggered from the slits in row B.

Figure 2:
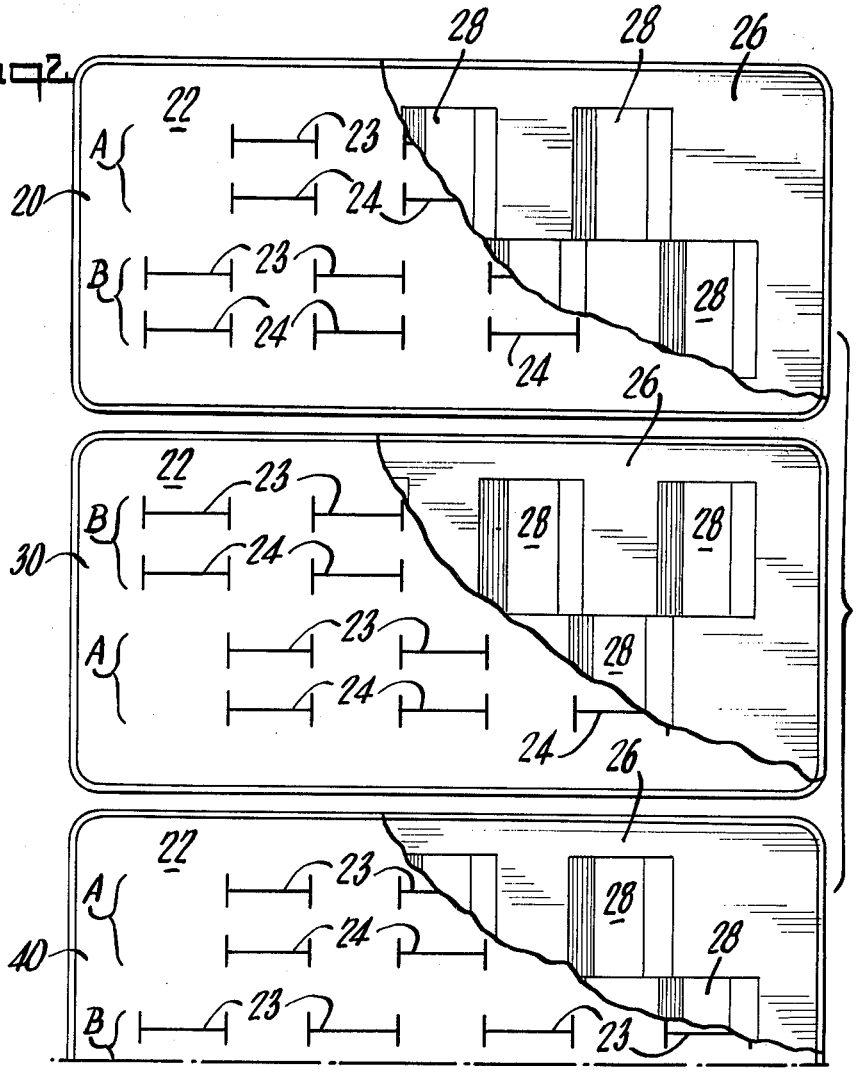
FIG. 2 is a top plan view of each of the trays shown in FIG. 1, a portion thereof being broken away.

Referring now to FIG. 2 it will be noted that tray 20 is oriented so that row A is located closer to the upper edge of the drawing sheet and row B is located closer to the lower edge of the drawing sheet. Row B of tray 30, however, is located closer to the upper edge of the drawing and row A is located closer to the lower edge of the drawing. In other words, tray 30 is rotated 180° with respect to the position of tray 20. Similarly, tray 40 is rotated 180° with respect to the position of tray 30. This is the position that trays 20, 30 and 40 will occupy when placed in the nested position shown in FIG. 1.

Figures 3, 4, 5, 5A:
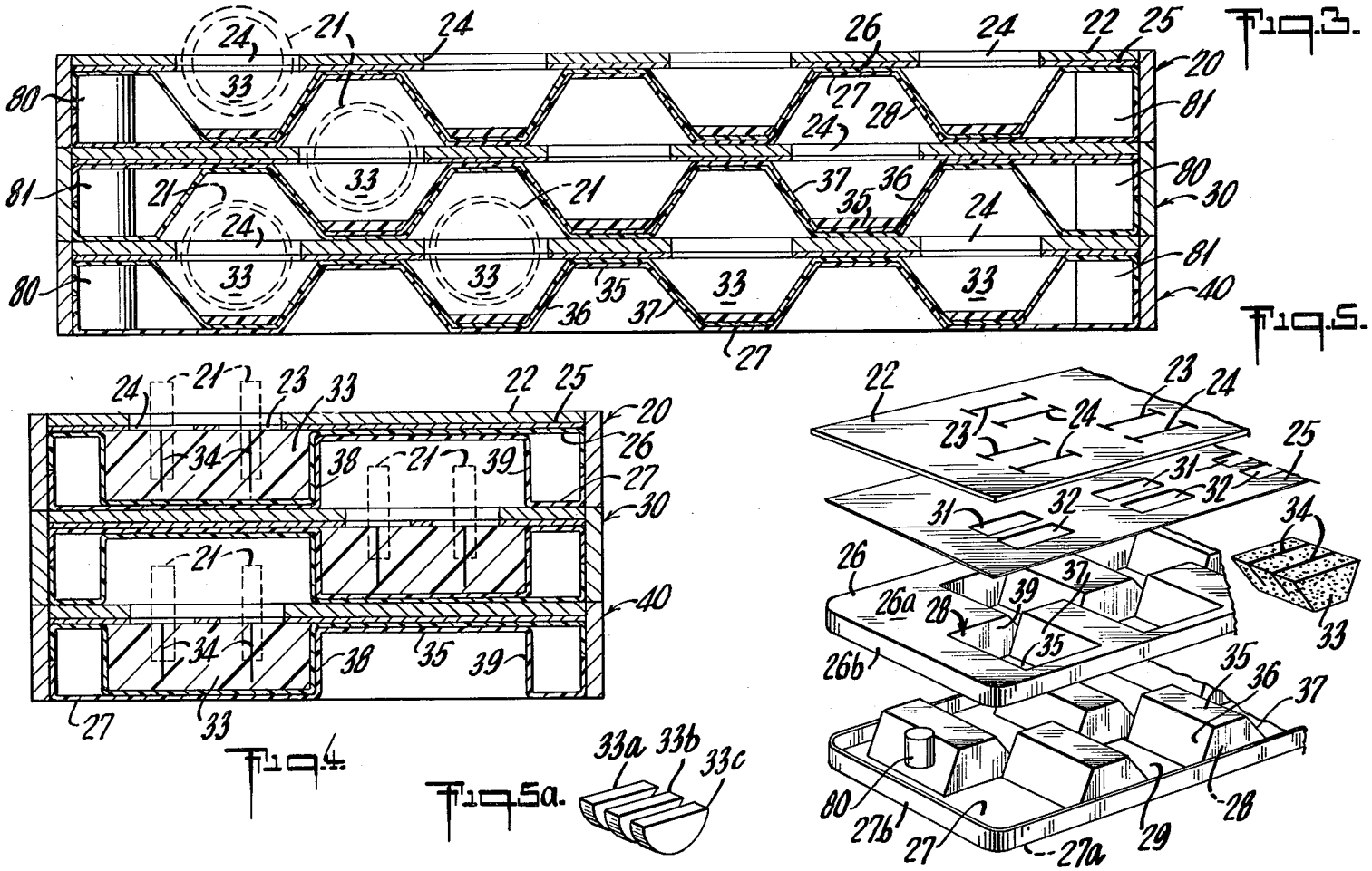
FIG. 3 is a sectional elevational view taken along line III—III of FIG. 1.
FIG. 4 is a sectional elevational view taken along line IV—IV of FIG. 1.
FIG. 5 is an exploded perspective view illustrating the elements comprising the display tray shown in the embodiment of FIGS. 1 through 4.
FIG. 5*a* is a perspective view of one feature of the invention.

With reference to FIG. 5, the various elements which comprise the structure of each of the jewelry display and storage tray devices shown in FIG. 1 is illustrated in perspective view. As shown in this figure, the tray includes an upper surface covering layer 22, an upper surface element 25, an upper member 26 and a lower member 27.

Upper and lower members 26 and 27 respectively are preferably made of lightweight styrene which can be vacuum formed into any desired shape and configuration. It should be understood, however, that members 26 and 27 can be made of other materials such as wood, lucite, metal, etc. In the embodiment illustrated in FIG. 5, members 26 and 27 are of substantially identical construction. As will be seen hereinafter with reference to other embodiments, the upper and lower members are usually not of identical construction. Each member has a major surface 26*a* and 27*a*, and a lip 26*b* and 27*b* extending peripherally about the member and perpendicularly away from the major surfaces 26*a* and 27*a* respectively.

Both the upper and lower members are provided with a plurality of recesses 28 and 28′ depending from the major surfaces of each member. The recesses of each member are similarly arranged in rows. In the present embodiment, each member has two rows of recesses, with the recesses in the first row being offset from the recesses in the second row. The recesses of each row are spaced so that when the lower member is inverted with respect to the upper member and oriented so that its first row of recesses is aligned with the second row of the recesses of the upper member, the upper and lower members will interlock, the recesses of each member fitting in between the recesses of the other member. In this manner a very rigid construction is established.

The upper surface element 25 may be formed of paper, plastic or other thin material. Pairs of rectangular openings 31, 32 are also arranged in rows so that each pair of openings is aligned with a recess 28 in the upper member 26. Upper surface covering layer 22 is preferably made of velvet or other materials such as fabric to attractively display the jewelry items contained in the tray. Other suitable materials, such as leather, velveteen, etc., may also be used. Slits 23 and 24 are arranged so as to align with rectangular openings 31 and 32. Accordingly, the ring or other jewelry item may be accommodated in the tray by being inserted into slits 23 or 24. The ring, watch or other item of jewelry, will then extend downwardly through the rectangular opening 31 or 32 and be accommodated within the recess 28. Recess 28, being accommodated within the space 29 between the recesses in the lower member 27, can thus easily accommodate each of the jewelry items.

A cellular sponge material 33 may be used to fill each of the recesses 28 in the upper member 26. The sponge material may be provided with slits 34 so that a ring or other jewelry item inserted into the recess will be securely held by the sponge 33.

Alternatively, as shown in FIG. 5*a*, semi-circular disc sections 33*a* and 33*b*, each covered by velvet, can be inserted into recesses 28 to secure the item of jewelry therebetween.

It will be more fully appreciated from FIG. 2 that, in the present embodiment, two jewelry items may be accommodated in each of the recesses 28. Accordingly, each pair of slits 23 and 24 will be aligned with a single recess 28.

Velvet or other material may be used to cover the peripheral edge of the tray so as to give the tray an attractive appearance. When the upper and lower members 26 and 27 are assembled and an appropriate covering material provided around the tray, an attractive display tray will be established in which jewelry items can be accommodated within the slits and held within the recesses for display in a jewelry cabinet or case.

The manner in which the trays 20, 30, 40, etc., can be arranged for storage will be more fully appreciated from FIGS. 2 and 4. When tray 30 is oriented 180° with respect to the position of tray 20, the recesses 28' in lower member 27 of tray 20 (which extend upwardly) will be positioned above the recesses 28 in the upper member 26 of tray 30. Accordingly, a ring 21 which is carried within a recess 28 of, for example tray 30, will have its upper exposed portion accommodated within the recess 28' of tray 20. In other words, recesses 28' in the lower member acts as a housing or covering for the upper portion of jewelry items carried in a lower tray.

It will be noted that recesses 28 and 28' are each formed with a bottom surface 35, sloping sidewalls 36 and 37 and end walls 38 and 39. In the presently described embodiment, sloping sidewalls 36 and 37 form an angle of approximately 30° with the top and bottom surfaces 26*a* and 27*a* respectively. As can be fully appreciated from FIG. 3, when a plurality of trays are nested together, the plurality of complementary fitting recesses form hexagonally shaped compartments to accommodate each of the jewelry items. In other words, a hexagonal compartment is formed between a recess 28' in the lower member 27 of one tray and the recess 28 formed in the upper member 26 of a complementary fitting tray. Hence, a honeycomb cross-sectional effect is produced.

Figure 6A:
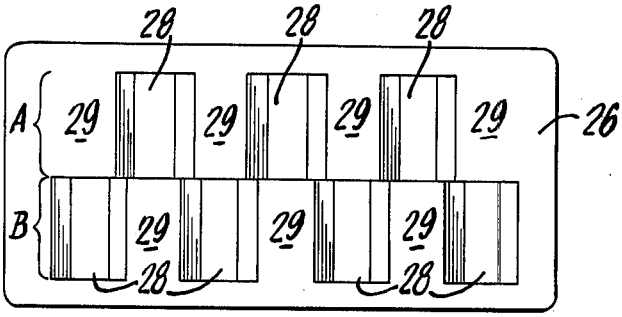
FIGS. 6*a* and 6*b* are top plan views illustrating the top and bottom members respectively of the display tray of the embodiment shown in FIG. 5.
Figure 6B:
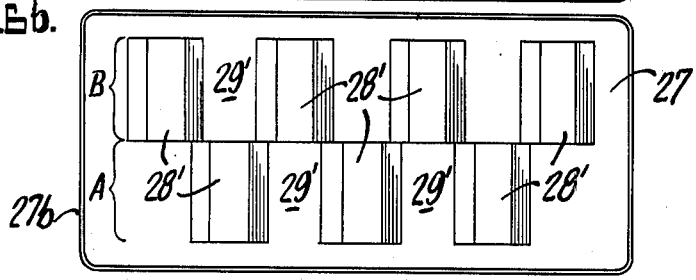

FIGS. 6*a* and 6*b* illustrate the arrangement of the upper member with respect to the lower member in order to form a nested rigid construction. Note there are two columns of recesses 28 in upper member 26 and two columns of recesses 28' in lower member 27. Since the upper and lower members are of substantially identical construction, rotating one of the members 180° with respect to the other member will enable the members to interlock and complimentarily fit together. Accordingly, recesses 28 will extend downward and be accommodated in spaces 29' of lower member 27. Similarly recesses 28' will extend upwardly and be accommodated in spaces 29 between the recesses 28 of upper member 26.

Figure 7A:
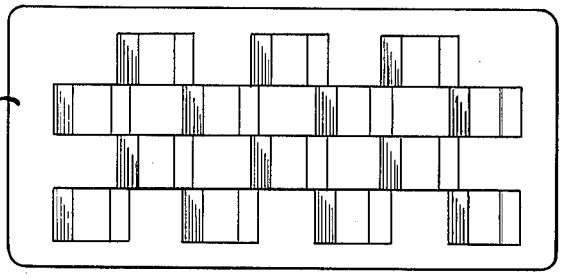
FIGS. 7*a* and 7*b* are top plan views illustrating the top and bottom members respectively of a further embodiment of the present invention which is designed to accommodate different size jewelry items or jewelry items of different configureation.
Figure 7B:
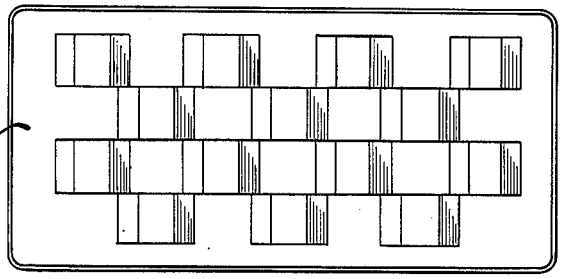

While the embodiment thus far described illustrates trays having two rows of recesses, each for accommodating two items of jewelry, FIGS. 7*a* and 7*b* illustrate upper and lower members 26' and 27' which have four rows of downwardly and upwardly extending recesses respectively. The recesses in this embodiment are similarly offset so that when lower member 27' is rotated 180° with respect to upper member 26', these members will interlock and fit together to form a rigid tray construction.

Figure 8:
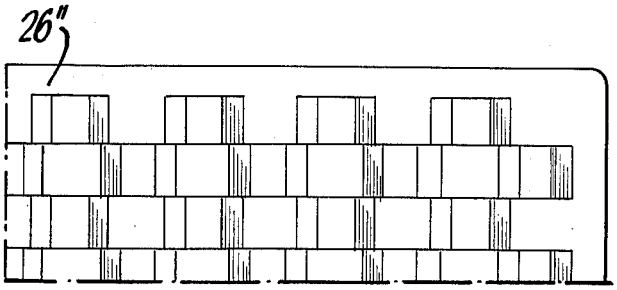
FIG. 8 is a partial top plan view of yet another arrangement of the embodiment shown in FIGS. 1 through 6.

FIG. 8 illustrates an embodiment of the invention which provides for an oversized or a larger tray which can have almost any number of recesses arranged in offsetting or staggered rows to present jewelry items in a spaced and pleasing arrangement.

It will be noted that in each of the embodiments thus far described, the overall shape of the display and storage tray is generally rectangular. It will of course be appreciated to those skilled in the art that almost any desired shape can be used. Once the principal of the invention is appreciated so that jewelry items can be accommodated in compartments between upper and lower recesses of nested trays, almost any configuration or design of tray can be used with the present invention.

While the hexagonally shaped compartments formed between opposing recesses of stacked trays has been found to be most suitable for accommodating substantially circular type items of jewelry, such as wedding bands, bracelets, etc., other types of jewelry will be more efficiently accommodated in compartments having different shapes and configurations. For example, referring to FIGS. 9 through 12 a further embodiment of the present invention particularly suited for displaying and storing rings having stones or other ornamentation is illustrated.

Figure 10:
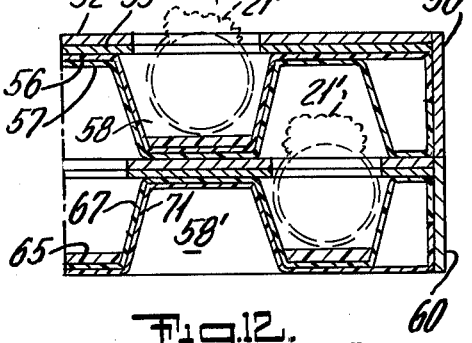
FIG. 10 is a sectional elevational view taken along line X—X of FIG. 9 and illustrating two of the trays shown in FIG. 9 in a nested condition.
Figure 11:
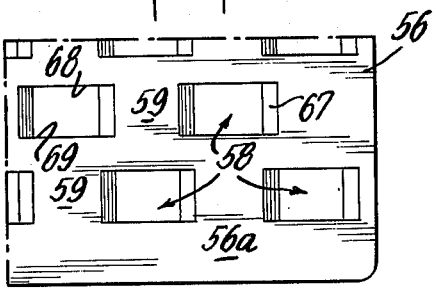
FIG. 11 is a top plan view of the upper member of the embodiment or configuration of the present invention shown in FIGS. 9 and 10.
Figure 12:
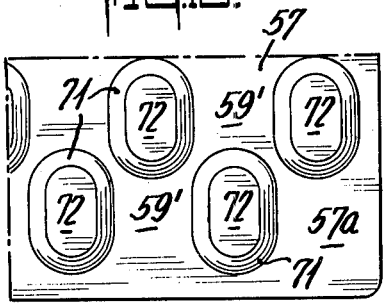
FIG. 12 is a top plan view illustrating the lower member associated with the embodiment illustrated in FIG. 11.

FIG. 10 shows two trays 50 and 60 in a nested condition for storage. Each of the trays of this embodiment is similarly constructed with upper and lower members. FIG. 11 illustrates in plan view the upper member 56 and FIG. 12 illustrates in plan view the lower member 57. In this embodiment, the recesses 58 of the upper member 56 are similarly shaped to the recesses illustrated in the embodiment shown in FIG. 5. Each of the recesses has a rectangularly shaped upper opening, sloping sidewalls 66 and 67, a bottom surface 65 and end walls 68 and 69. Each of the recesses 58 of the upper member 56 are arranged in rows so that the recesses of one row are offset from the recesses of a second row.

The upwardly extending recesses 58' in the lower member 52 have an oval shaped configuration with a sloping peripheral surface 71 and an end wall 72. The upwardly extending recesses 58' of the lower member 57 will fit in the spaces 59 located between the downwardly extending recesses 58 of upper member 58' will engage and fit complementarily with the sloping sidewalls 66 and 67 of the downwardly extending recesses 58. Accordingly, downwardly extending recesses 58 will be located in the spaces 59' between the upwardly extending recesses 58' of the lower member 57.

Sloping sidewalls 66 and 67 of recesses 58 and sloping wall 71 of upwardly extending recess 58' each form an angle of approximately 15° with the major surfaces 56*a* and 57*a* of the upper and lower members respectively. Accordingly, when tray 50 is nested with tray 60, an upwardly extending recess 58' formed in the lower member 57 of tray 50 will be aligned with a downwardly extending recess 58 in the upper member 56 of tray 60 to form a compartment for accommodating a ring or other piece of jewelry having a stone or ornamentation on it.

Figure 9:
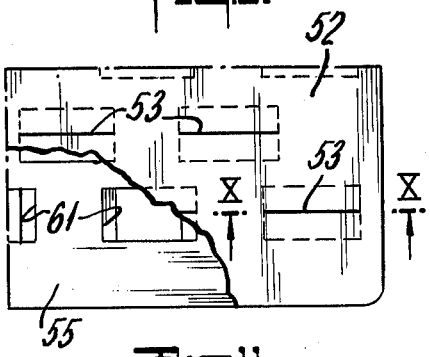
FIG. 9 is a partial top plan view showing yet a further embodiment of the present invention and particularly suited for accommodating rings which carry stones or ornaments.

It should be noted from FIG. 9 that an upper surface covering 52 has only a single slot 53 aligned with each of the recesses. Therefore, in this embodiment only a single piece of jewelry will be accommodated in each recess, unlike the previously described embodiment in which two pieces of jewelry will be accommodated in each recess. Accordingly, a single slit 53 is provided for each recess. As in the previously described embodiment, an upper surface element 55 formed of cardboard or other thin material will preferably be placed between the upper member 56 and the upper surface covering layer 52. The upper surface element 55 is provided with a plurality of rectangularly shaped openings 61.

As in the previously described embodiment, each of the downwardly extending recesses 58 will be provided with cellular material or other means for holding the jewelry item within the recess. Also an appropriate material or velvet covering may be provided around the tray.

Figure 13:
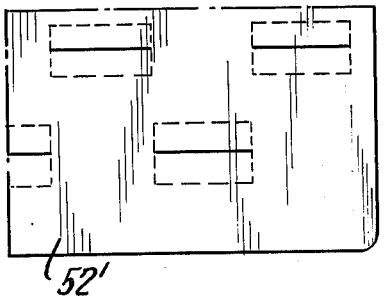
FIG. 13 is a partial top plan view of a top surface element for yet a further embodiment of the present invention.
Figure 14:
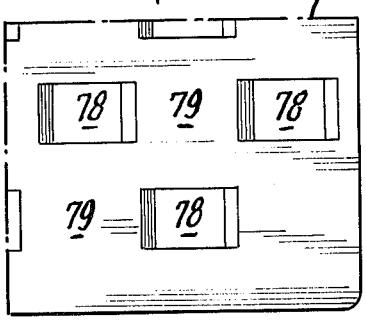
FIG. 14 is a top plan view of the upper member of the embodiment or configuration for the present invention shown in FIG. 13.
Figure 15:
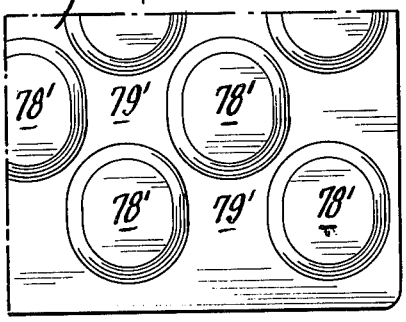
FIG. 15 is a top plan view of the lower member for the embodiment shown in FIG. 14.

Referring now to FIGS. 13, 14 and 15 yet a further embodiment of the present invention is illustrated. In this embodiment, an upper member 76 is provided with downwardly extending recesses 78 having a shape and configuration similar to the recesses illustrated in FIG. 11. The upwardly extending recesses 78' of the lower member 77 are shaped as a truncated cone extending in an upward direction. As in the previous embodiment, the recesses of both the upper and lower members are arranged in offsetting or staggered rows so that the downwardly extending recesses of the upper member 76 will be accommodated in spaces 79' between the lower recesses 78' of the lower member 77 when the upper and lower members are assembled together. Similarly, the upwardly extending recesses 78' will fit between the recesses 78 of the upper member 76 in spaces 79. Thus, an interlocking structure is created. In this manner, when two trays of this construction are placed one on top of the other for storage, an upwardly extending recess 78', formed in the lower member 77 of the upper tray, aligned with a downwardly extending recess 78, formed in the upper member 76 of the lower tray, wil form a compartment having a somewhat different shape and configuration than that described or illustrated in either FIGS. 3 or 10. Accordingly, jewelry items of different shapes and designs can be accommodated for display and storage in trays having upper and lower members with different shaped recesses.

Figure 16:
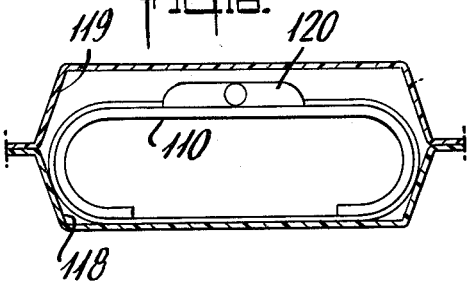
FIG. 16 is a fragmented sectional view showing two nested trays for holding watches.

FIG. 16 illustrates an embodiment of the invention for storing and displaying watches. A support 110 is accommodated in a downwardly extending recess 118 (rather than the sponge material) for holding a watch 120. When nested with another tray, an upwardly extending recess 119 will cover and protect the watch 120. As shown, approximately one-half the depth of the oval support 110 and watchband around it will be within the recess 118. The upper half will be exposed for display. For rings with stones, half the height of the entire ring, i.e., from the bottom of the shank to the top of the stone, will be within the downward recess so that more than half the diameter of the shank is within the recess.

In each of the embodiments, it is of course an essential feature that the upwardly extending recesses of one tray be aligned with the downwardly extending recesses formed in an upper member of another tray. Since the recesses are arranged in offsetting rows, it is a requirement that stacked trays have their arrangement of rows rotated 180° with respect to each other. With the trays filled with pieces of jewelry it will be obvious to anyone using the trays to rotate adjacent trays until nesting is accomplished.

A further feature of the present invention is the provision of permanent magnets 80 and 81. These magnets are arranged at opposite ends of each tray. The arrangement of the poles of each of the magnets 80 and 81 will be inverted so that adjacent trays having permanent magnets oriented in the identical manner will only be able to fit together when magnet 81 of one tray is aligned with magnet 80 of an adjacent tray. The use of magnets has been found to be desirable in maintaining nested trays in a storage condition. The use of magnets as provided herein, will also allow the trays to be used in more creative presentations. Specifically, trays using magnets as provided for herein can be used in displays where the trays are mounted to the sides of vertical or sloping walls.

While the present invention has been described and illustrated with respect to certain preferred embodiments, which produce satisfactory results, it will be appreciated by those skilled in the art, after understanding the purposes of the invention, that various other changes and modifications may be made without departing from the spirit and scope of the invention, and it is therefore intended to cover all such changes and modifications in the appended claims.

It is claimed:

1. A jewelry display tray comprising an upper member, a plurality of recesses formed in said upper member extending in a downward direction when a major plane of said tray is oriented in a substantially horizontal direction, said recesses being arranged in offsetting rows, a lower member having a plurality of recesses extending in an upward direction when the major plane of said tray is in a horizontal position, said upwardly extending recesses arranged in offsetting rows, said upper and lower members being complimentarily fit together with said downwardly extending recesses of said upper member fitting in spaces located between said upwardly extending recesses of said lower member, said upwardly extending recesses of said lower member fitting in spaces located between said downwardly extending recesses of said upper member, whereby said upper and lower members form an interlocking structure, and means having access openings overlying said upper member so that the items of jewelry passing through said openings will be accommodated in said downwardly extending recesses of said upper member, whereby upwardly extending recesses of a first tray aligned with downwardly extending recesses of a second tray form compartments for accommodating items of jewelry when said first and second trays are positioned one on top of the other.

2. The jewelry display tray according to claim 1 further comprising an upper surface element overlaying said upper member, a plurality of substantially rectangularly shaped openings provided in said upper surface element, each of said openings aligned with one of said downwardly extending recesses of said upper member to provide access to said recesses for receiving an item of jewelry.

3. The jewelry display tray according to claim 2 further comprising an upper surface cover layer overlaying said upper surface element, a plurality of slits provided in said upper surface cover layer, each of said slits being aligned with said openings in said upper surface element to provide access thereto for receiving an item of jewelry.

4. The jewelry display tray according to claim 2 wherein there are two openings aligned with each downwardly extending recess of said upper member so that each recess will receive two items of jewelry.

5. The jewelry display tray according to claim 3 wherein a single opening in said upper surface element is aligned with each downwardly extending recess of said upper member so that a single item of jewelry is accommodated in each recess.

6. The jewelry display tray according to claim 3 wherein said upper surface covering layer is made of velvet.

7. The jewelry display tray according to claim 3 further comprising a covering material overlaying the under surface of said lower member.

8. The jewelry display tray according to claim 3 wherein said upwardly extending recesses of said lower member and said downwardly extending recesses of said upper member are of identical shape and construction, each said recess having a substantially rectangular opening, a bottom surface extending in a plane substantially parallel to the major surface of said upper and lower members, end walls extending in a direction substantially perpendicular to the plane of the major surfaces of said upper and lower members, and sloping side walls oriented at approximately 30° with respect to the plane of the major surface of said upper and lower members.

9. The jewelry display tray according to claim 3 wherein said downwardly extending recesses of said upper member have a substantially rectangularly shaped opening, end walls extending in a direction substantially perpendicular to the plane of the major surface of said upper member, and sloping side walls extending at an angle to the plane of the major surface of said upper member.

10. The jewelry display tray according to claim 9 wherein said upwardly extending recesses of said lower member are oval shaped having sloping side walls which fit complimentarily with the sloping side walls of said downwardly extending recesses of said upper member.

11. The jewelry display tray according to claim 9 wherein said upwardly extending recesses of said lower member are shaped as a substantial truncated cone.

12. The jewelry display tray according to claim 3 wherein said recesses of said upper and lower members are arranged in first and second rows, there being one or more recess in the second row than in the first row.

13. The jewelry display tray according to claim 3 wherein adjacent rows of recesses have different numbers of recesses, the recesses of one row being positioned substantially between the recesses of an adjacent row.

14. The jewelry display tray according to claim 1 further comprising means carried within said downwardly extending recesses of said upper member to receive and support an item of jewelry therein.

15. The jewelry display tray according to claim 3 further comprising magnetic means carried within said tray to provide means for magnetic attraction between nested adjacent trays when in a storage condition.

* * * * *